US007438268B2

(12) United States Patent
Kologe

(10) Patent No.: US 7,438,268 B2
(45) Date of Patent: Oct. 21, 2008

(54) DISPLAY BAR ASSEMBLY FOR MERCHANDISING DISPLAYS

(75) Inventor: Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 11/741,848

(22) Filed: Apr. 30, 2007

(65) Prior Publication Data

US 2008/0203040 A1 Aug. 28, 2008

Related U.S. Application Data

(63) Continuation-in-part of application No. 11/741,317, filed on Apr. 27, 2007, and a continuation-in-part of application No. 11/679,507, filed on Feb. 27, 2007, now Pat. No. 7,404,533.

(51) Int. Cl.
*A47B 96/06* (2006.01)

(52) U.S. Cl. ..... 248/220.22; 248/251; 248/558; 248/911

(58) Field of Classification Search ..... 248/220.22, 248/558, 911, 243, 251, 254, 261, 262, 266, 248/267; 160/330, 383; 211/16, 78, 105.1, 211/123, 124; 403/298, 296, 350, 353
See application file for complete search history.

(56) References Cited

U.S. PATENT DOCUMENTS 3,960,275 A 6/1976 Haughton et al.
3,983,822 A 10/1976 Suttles
4,150,753 A 4/1979 Stahl et al.
4,316,546 A 2/1982 Varon et al.
4,316,547 A 2/1982 Varon
4,455,007 A 6/1984 Varon et al.
4,474,299 A 10/1984 Andrews
4,874,148 A 10/1989 Guinter
D368,218 S 3/1996 Klein, III
5,582,376 A 12/1996 Thompson
6,029,833 A 2/2000 Yeh
6,062,399 A 5/2000 Henry et al.
6,293,507 B1 9/2001 Gorniak
2006/0021722 A1 2/2006 Nien

*Primary Examiner*—Korie H. Chan
(74) *Attorney, Agent, or Firm*—Schweitzer Cornman Gross & Bondell LLP

(57) ABSTRACT

A display bar assembly for mounting on spaced apart slotted uprights on a merchandising gondola or the like. A tubular display bar of polygonal cross section is fitted with a pair of mounting brackets, which are slideable along the bar to enable spacing of the mounting brackets to agree with the spacing between the slotted uprights, which can be somewhat variable. The mounting brackets are formed with openings which closely and non-rotatably receive the display bar and are provided with hooks which engage slots in the uprights. Flanged end plugs are received tightly in each end of the display bar to prevent removal of the slideable brackets, such that the display bar and brackets form a permanent assembly. The mounting brackets may have multiple slot-engaging hooks for installation on uprights of different thicknesses in different rotary positions of the assembly. Where necessary to maintain a predetermined orientation of the display bar, the display bar can be formed with an axially limited portion of reduced cross section, enabling the mounting brackets, when positioned thereat, to be rotationally reoriented relative to the display bar.

11 Claims, 7 Drawing Sheets

DISPLAY BAR ASSEMBLY FOR MERCHANDISING DISPLAYS

RELATED APPLICATIONS

This application is a continuation-in-part of my application Ser. No. 11/679,507, filed Feb. 27, 2007, now U.S. Pat. No. 7,404,533 and of my co-pending application Ser. No. 11/741,317, filed Apr. 27, 2007.

BACKGROUND OF THE INVENTION

Merchandise displays frequently are arranged by mounting shelves and other display elements on a gondola or other display wall. Commonly, such display walls are provided with spaced apart, slotted uprights in the form of U-shaped metal channels provided substantially along their full length with uniformly spaced apart slots. The slots are adapted to receive shelf brackets, for example, and various other devices and apparatus utilized in connection with the display of merchandise.

One common display apparatus consists of a horizontal display bar, typically of square or rectangular cross section, which is held at its opposite ends by brackets. The brackets are arranged for adjustable movement along the length of the display bar, to accommodate for different spacings between uprights, and serve to mount the display bar on the uprights. Typically, the mounting brackets are provided with upwardly opening recesses to receive the display bar. In some cases, openings, closed on all sides, receive the display bar.

A serious disadvantage of these prior art devices is that the mounting brackets are separable from the display bar. Accordingly, when the display facilities are removed from the uprights, and reused elsewhere or stored between uses, the mounting brackets easily can become separated and lost or misplaced relative to the display bar for which they were intended. A display bar with a single mounting bracket is useless and much valuable employee time can be wasted trying to find all of the parts of a set so that they may be properly reused. The net result, frequently is considerable inefficiency and unnecessary expense and in the managing of store displays.

SUMMARY OF THE INVENTION

A display bar assembly according to the invention is comprised of a display bar of polygonal configuration, typically square, and preferably hollow. Mounting brackets are provided for each end of the display bar, and these are formed with openings, substantially closed on all sides, and of a configuration generally corresponding to that of the display bar. It is not necessary that the openings be totally closed, but they should be sufficiently closed that the display bar can be removed therefrom only by movement in the direction of the longitudinal axis of the display bar. When applied over the display bar, the mounting brackets are normally nonrotatable with respect to the bar.

Pursuant to one aspect of the invention, retaining elements are applied to each end of the display bar, after the mounting brackets are assembled thereon. The retaining elements advantageously are in the form of flanged plugs, which can be inserted in and tightly retained by the opposite ends of the display bar. The plugs form and end flange at the end extremities of the display bar, to prevent the removal of the mounting brackets. In this respect, the device of the invention is a complete assembly of the display bar and mounting brackets, with the brackets being effectively nonremovable and always retained with the display bar for use when and where the store manager desires.

In one preferred embodiment of the invention, the mounting brackets are each provided with a pair of angularly oriented mounting hooks arranged to be received in slots in the spaced uprights, as a means for attaching the display bar assembly to the uprights. The slot-engaging hooks are of generally L-shaped configuration defining, with an edge of the bracket, an open ended recess for receiving wall material of the upright, when the hook is engaged in a slot on the upright. To advantage, the two hooks are positioned on adjacent side edges of the brackets, oriented at 90 degrees to each other. The recess formed by one of the hooks is of greater width than that of the adjacent, angularly disposed hook. The arrangement is such that, by rotating the bar and bracket assembly 90 degrees, a different pair of slot-engaging hooks can be positioned to be inserted in the uprights. This arrangement accommodates the fact that some uprights are formed with heavier, thicker metal walls than others, and the best fit can be achieved easily with the assembly of the invention by rotating the bar to select the proper width of hook recess.

Desirably, the slot-engaging hooks provided on the mounting brackets are offset slightly to the outside of the principal plane of the brackets. Thus, in cases where two display bars are mounted more or less end to end in a display arrangement, adequate clearance is provided for the presence of the flanged end plugs.

In another advantageous embodiment of the invention, the display bar is designed for mounting of special display hooks, which require the display bar to be provided with openings on the front and back sides to receive the display hooks. Accordingly, in this embodiment of the invention, the display bar itself must remain in a predetermined orientation, appropriate for the display hooks, and this in turn requires that the mounting brackets be rotatable with respect to the display bar, in order to present a different set of slot-engaging hooks to the slotted uprights. For this embodiment of the invention, the display bar is provided at a limited number of locations (preferably a single location) with indentations at the four corners of the display bar, forming notches in the corners. The openings in the mounting brackets for this second embodiment can be primarily circular in shape, of a diameter corresponding to the diagonal dimension of the display bar at the corner notches. In addition, the mounting brackets are provided with angularly spaced recesses, corresponding in size and position with the location of the four corners of the display bar. When the brackets are positioned on the display bar at any axial location except the notched area, the corners of the display bar are received in the recesses in the mounting brackets, and the display bar is locked against rotation with respect to the mounting brackets. However, when a mounting bracket is moved longitudinally along the bar to the location of the corner notches, the bracket may, when in that position, be rotated relative to the display bar to bring a different hook into operative position. Thereafter, the bracket is moved away from the location of the notches, and is once again locked against rotation with respect to the display bar. Preferably, the width of the corner notches is such as to accommodate both mounting brackets simultaneously, so that the rotational adjustment of the mounting brackets relative to the display bar may be quickly accomplished.

For a more complete understanding of the above and other features and advantages of the invention, reference should be made to the following detailed description of a preferred embodiment, and to the accompanying drawings.

DESCRIPTION OF A PREFERRED EMBODIMENT

Figure 1:
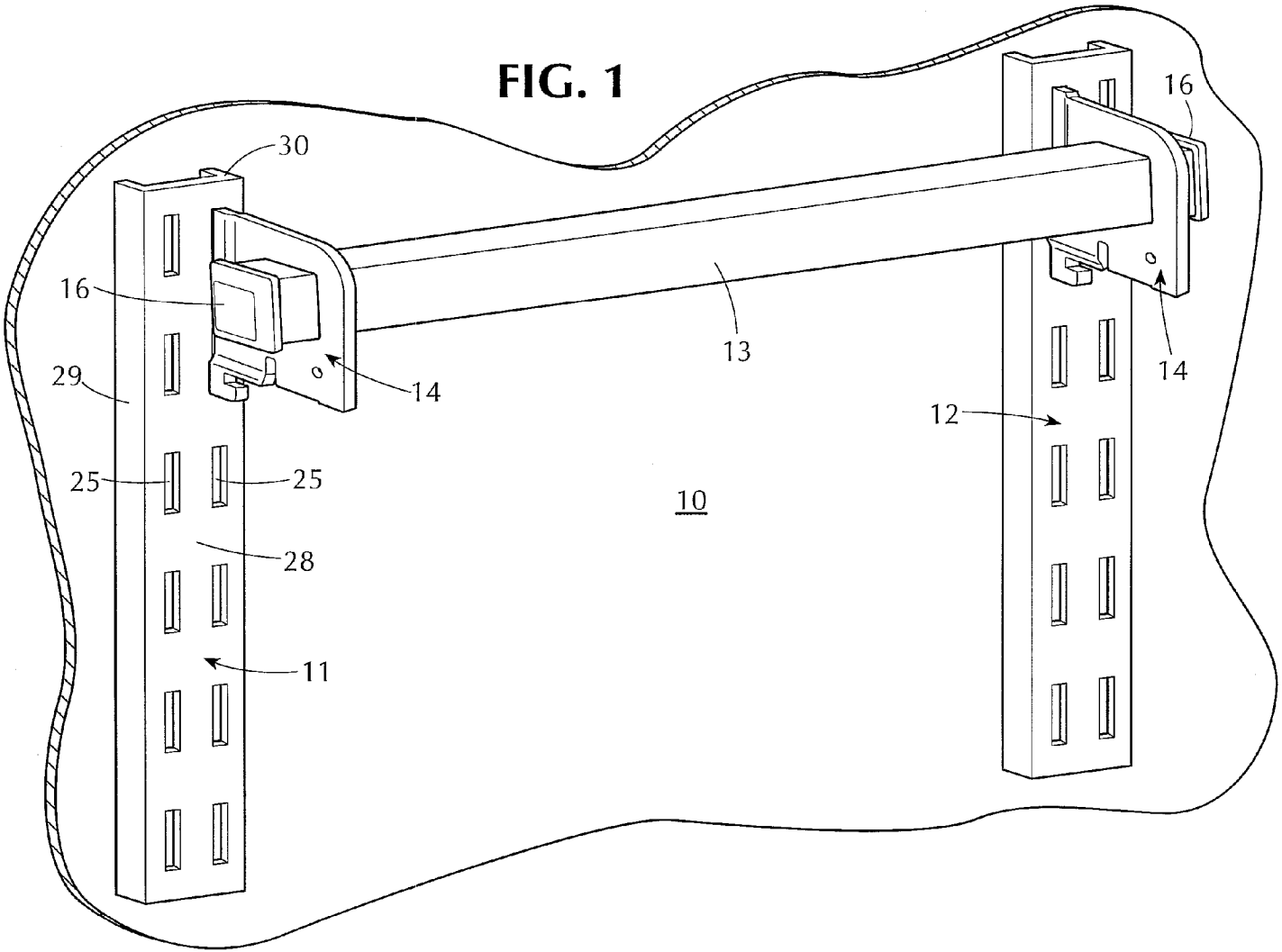
FIG. 1 is a perspective view of a typical merchandise display structure on which a display bar assembly according to one embodiment of the invention has been installed.
Figure 2:
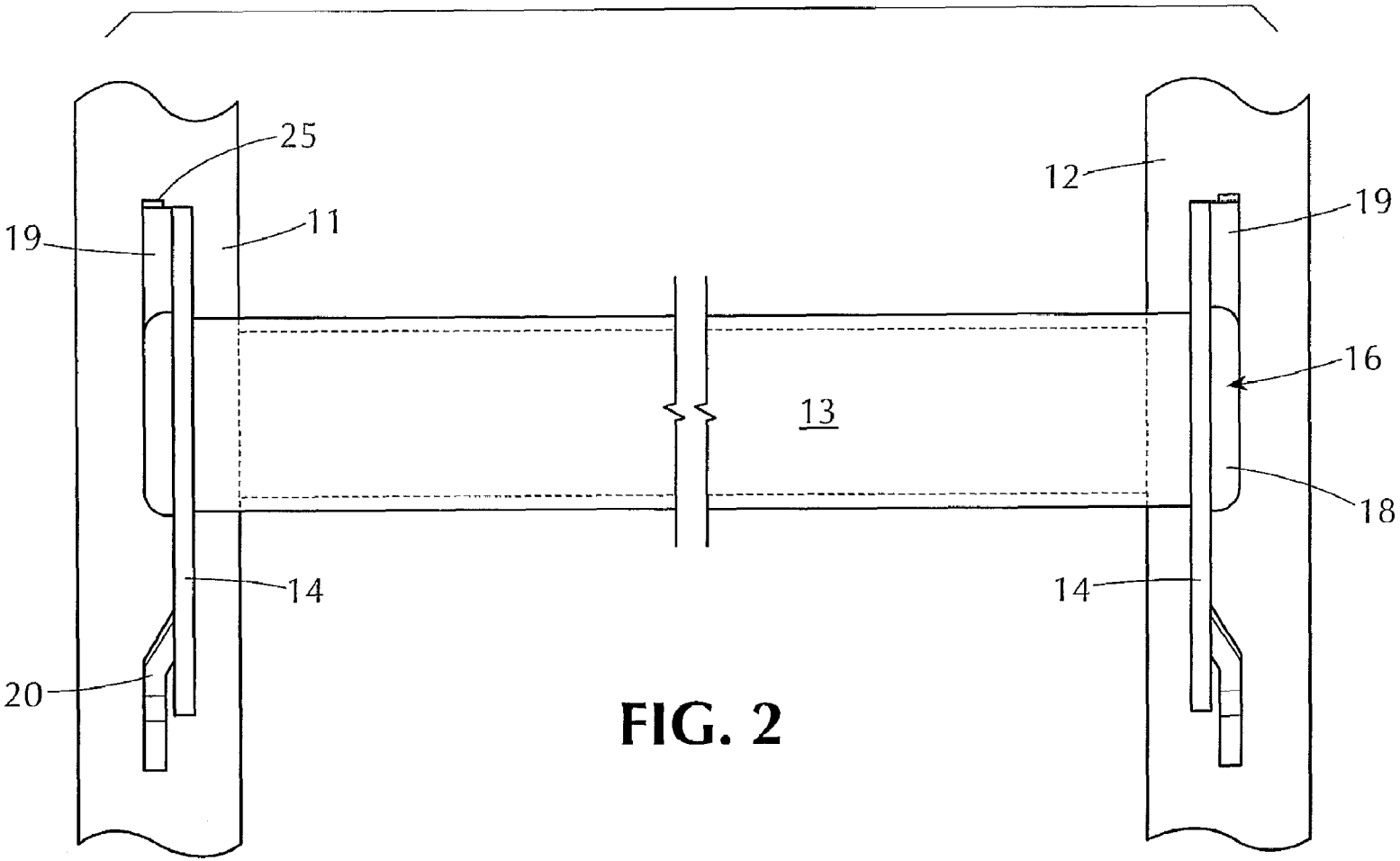
FIG. 2 is a front elevational view of an installation similar to that of FIG. 1.

Referring now to the drawings, the reference numeral 10 designates generally a display wall, which can be a gondola, for example, or simply a vertical wall structure. Mounted on the wall 10 are spaced apart slotted uprights 11, 12, which are suitably secured to the wall 10 and extend vertically more or less along its entire vertical extent. Typical merchandise display arrangements tend to use somewhat standardized spacings for the uprights 11, 12, for example approximately thirty inches, thirty-six inches and forty-eight inches. The uprights can be used for mounting a wide variety of display devices, such as shelf-supporting brackets, bins, etc. and including display bars such as shown at 13 in FIG. 1. Typically, the display bars themselves are used to mount hooks or other devices on which merchandise can be suspended and displayed.

At each end of the display bar 13 is a mounting bracket 14, to be described further, by which the display bar 13 is mounted on and secured to the uprights 12. Typically, the spacing between the uprights 11, 12, though more or less standardized, frequently is inaccurate. Accordingly, it is customary for mounting brackets to be adjustably associated with the display bar mounted thereby. Commonly, the brackets are provided with upwardly opening recesses for receiving the display bar. After mounting of the brackets on uprights, the display bar is lowered into the upwardly opening recesses, which nonrotatably retain the display bar. In some cases, the brackets are formed with openings which are closed on all sides, and the brackets are slidably assembled onto the ends of the display bar before the brackets are engaged with the uprights. In either case, the brackets are separable from the display bar and often become misplaced, resulting in considerable inefficiency and expense to the storekeeper. In the system of the invention, the mounting brackets 14, are formed with openings 15, at least partly closed on all sides to prevent lateral separation, and configured to closely but slidably receive the display bar 13. In the illustrated arrangement, the display bar 13 has a square cross section, uniform along its full length, and the openings 15 are of a corresponding shape, with a small clearance provided to accommodate slidable adjustments of the brackets. Unlike the prior art, however, the display assembly of the invention includes means for permanently retaining the mounting brackets on the display bar 13.

Figure 3:
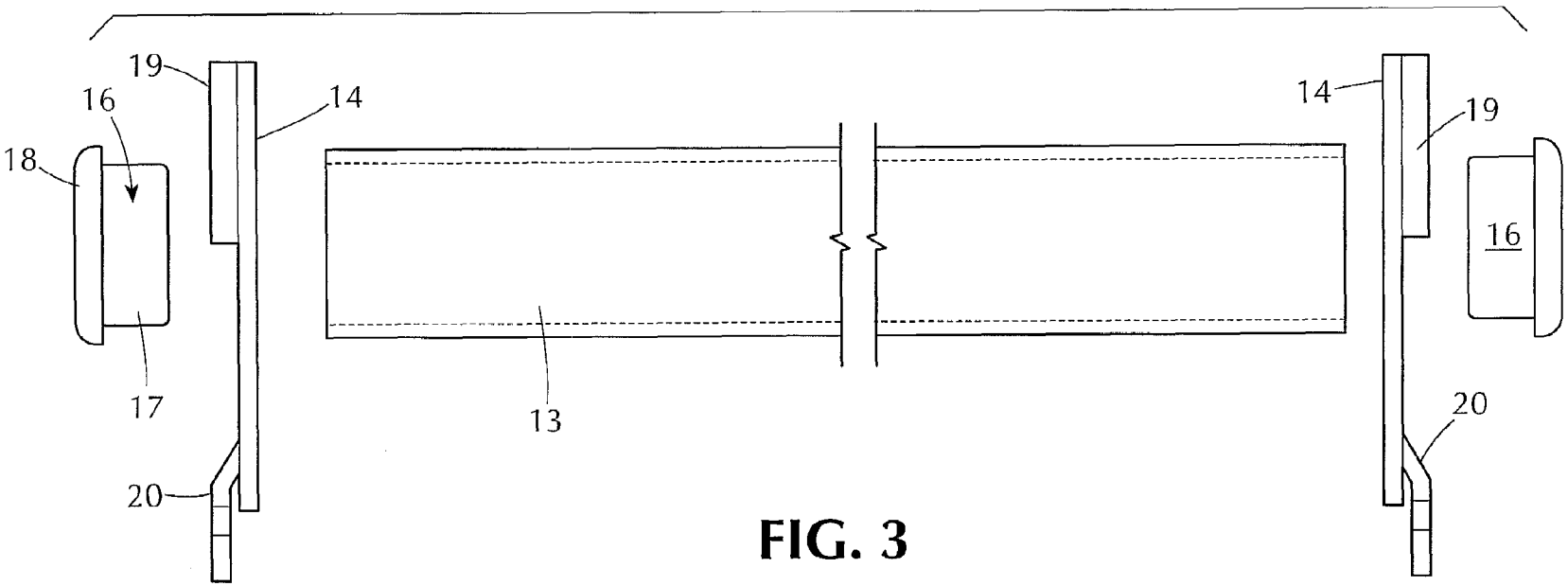
FIG. 3 is an exploded view of the display bar assembly of FIG. 1.

In the assembly of the invention, after initial assembly of the brackets 14 onto the display bar, flanged end plugs 16 are applied to the opposite ends of the display bar. As shown in FIG. 3, the flanged plugs are formed with a body portion 17, of a size and shape to fit inside the hollow display bar, with a tight friction fit such that, once applied to the end of the display bar, the plugs 16 will be removable only with great difficulty. The plugs are each provided with an outwardly projecting flange portion 18. The dimensions of the projecting flange portions 18 are at least slightly greater than the dimensions of the bracket openings 15, so that after application of the plug 16 to the display bar, the mounting brackets 14 are blocked by the end plugs 16 and can no longer be removed. Thus, at all times, the display bar and its mounting brackets will comprise an assembled unit. When the time comes to retrieve a display assembly from storage, or otherwise ready it for mounting on a pair of uprights 11, 12, there can be no problems with lost or missing brackets, as is consistently experienced with devices of previous design. The flanged end plugs 16 can be formed of a suitable tough plastic material such that they can easily be tapped into the ends of the display bar, but not easily removed therefrom.

Figure 5:
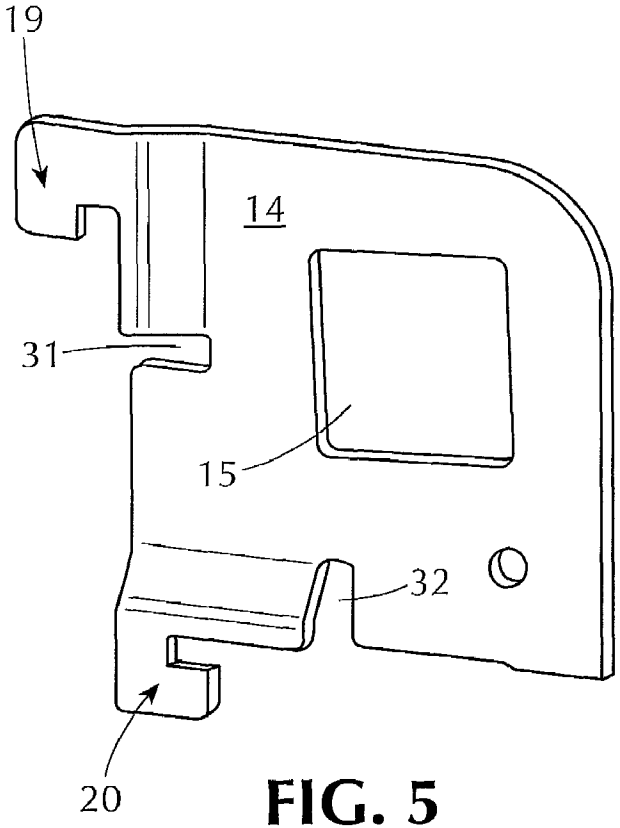
FIG. 5 is a perspective view of the mounting bracket utilized in the embodiment of the invention shown in FIG. 1.
Figure 4:
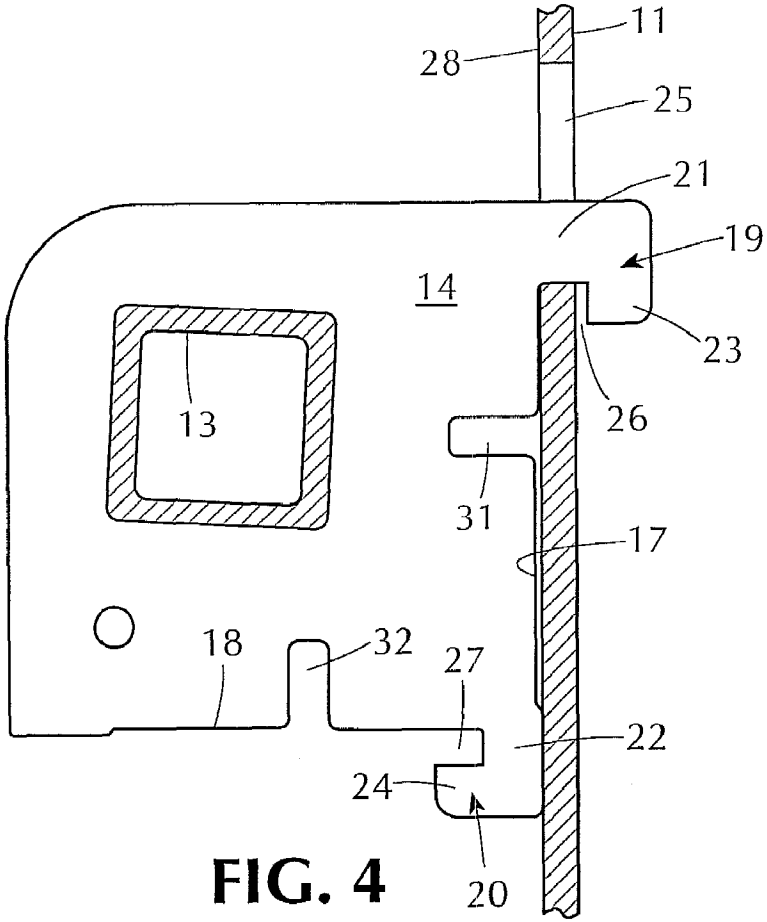
FIG. 4 is a cross sectional view as taken generally on line 4-4 of FIG. 2.

Referring now to FIGS. 4 and 5, mounting brackets incorporated in a first preferred embodiment of the invention comprise sheet metal stampings preferably somewhat squarish in outline, with side edges 17, 18 disposed at right angles. On the side edges 17, 18, there are formed mounting hooks 19, 20 respectively, which are generally of L-shaped configuration comprising lateral extensions 21, 22 and hook portions 23, 24 spaced from the adjacent side edges 17, 18 respectively. The two mounting hooks 19, 20 are oriented at right angles to each other arranged such that 90 degrees rotation of the mounting brackets 14 and display bar 13 enables a selected pair of the hooks 19, 20 to be received in slots 25 in the uprights.

Recesses 26, 27 are formed between the respective side edges 17, 18 of the mounting brackets and the hook portions 23, 24. To advantage, the widths of the respective recesses 26, 27 differ, so as to more suitably fit with the uprights 11. In this respect, the uprights typically are of a U-shaped cross section, with front walls 28 and side walls 29, 30, typically formed of rolled sheet metal. Some uprights may be of a heavier gauge construction than others, for supporting heavier loads. Thus, the recesses 26, 27 of the mounting brackets are arranged in different widths, to fit more appropriately on heavier gauge and lighter gauge uprights. Additionally, the recesses 26, 27 of a bracket 14 are unidirectionally oriented, to open in the same clockwise direction, i.e., clockwise as viewed in FIG. 4 or counterclockwise as viewed in FIG. 5.

Preferably, the mounting hooks 19, 20 of the brackets 14 are offset laterally a short distance (for example an eighth inch) from the outside face of the bracket. In this respect, the brackets will be provided in pairs for installation at the left and right ends respectively of the display bar, with the hook portions being offset to the outside, substantially as shown in FIG. 3. To accommodate the offsetting of these hook portions, the brackets are formed with cutouts 31, 32 extending into the bracket body from the respective side edges 17, 18, so that the portion of the bracket adjacent to the hook can be appropriately displaced out of the principal plane of the bracket.

Figure 6:
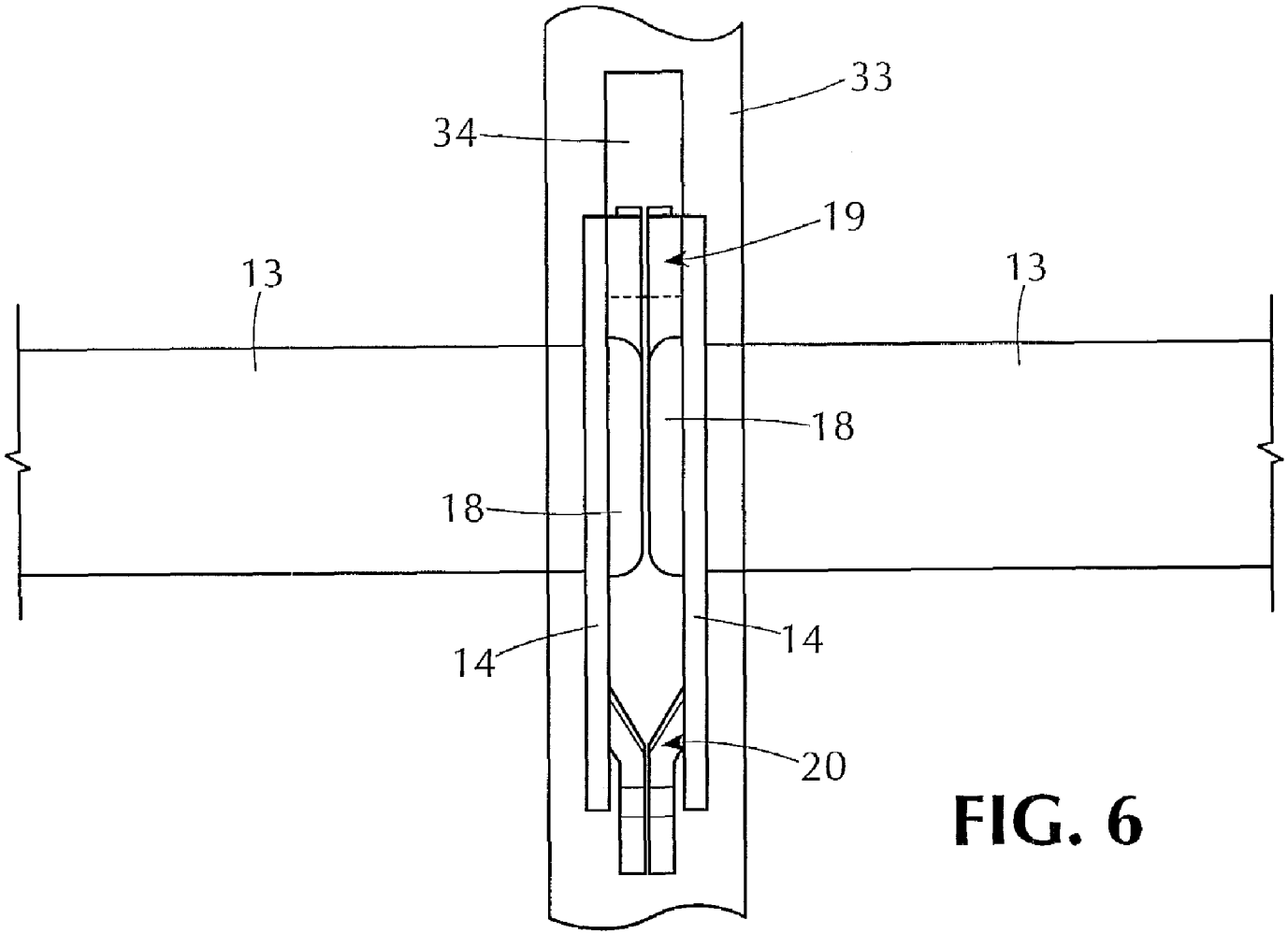
FIG. 6 is a fragmentary front elevational view illustrating two display bars arranged in an end-to-end configuration in a typical merchandise display.

The displacement of the hooks 19, 20 is advantageous for installations, such as shown in FIG. 6, in which an upright 33 may be provided with vertically spaced slots 34 of double width, in place of the alternative form in which the slots 25 are provided in adjacent pairs, as shown in FIG. 1. In an arrangement as shown in FIG. 6, where it may be desired to have display bars 13 aligned axially, end-to-end, the offsetting of the mounting hooks 19, 20 allows space between the main body of the brackets 14 to receive the flange portions 18 of the end plugs.

In the embodiment of FIGS. 1-6, product display hooks (not shown) typically are provided with a mounting bracket of inverted U-shaped configuration, adapted to fit snugly over the display bar. Inasmuch as the display bar 13 normally is of a square configuration, the display hooks can be mounted on the display bar in any rotational orientation thereof. Some merchants, however, prefer a different form of display hook consisting essentially of a single wire which is engaged in support openings formed in opposite (i.e., front and back) faces of the display bar, such as shown at 40, 41 in the display bar 42 shown in FIGS. 7 and 8. These special display hooks, which are not shown but are well known in the art, have a shaped portion conforming to and engageable in the shaped front opening 40, and a circular portion engageable in the opening 41 in the back wall of the display bar. The two spaced openings 40, 41 rigidly support the display hook at a desired angle, while the shaped front opening 40 cooperates with a similarly shaped portion of the display hook to prevent rotation of the display hook. The hook itself, and the arrangement for supporting the hook, is well known and, per se, forms no part of this invention.

Figure 7:
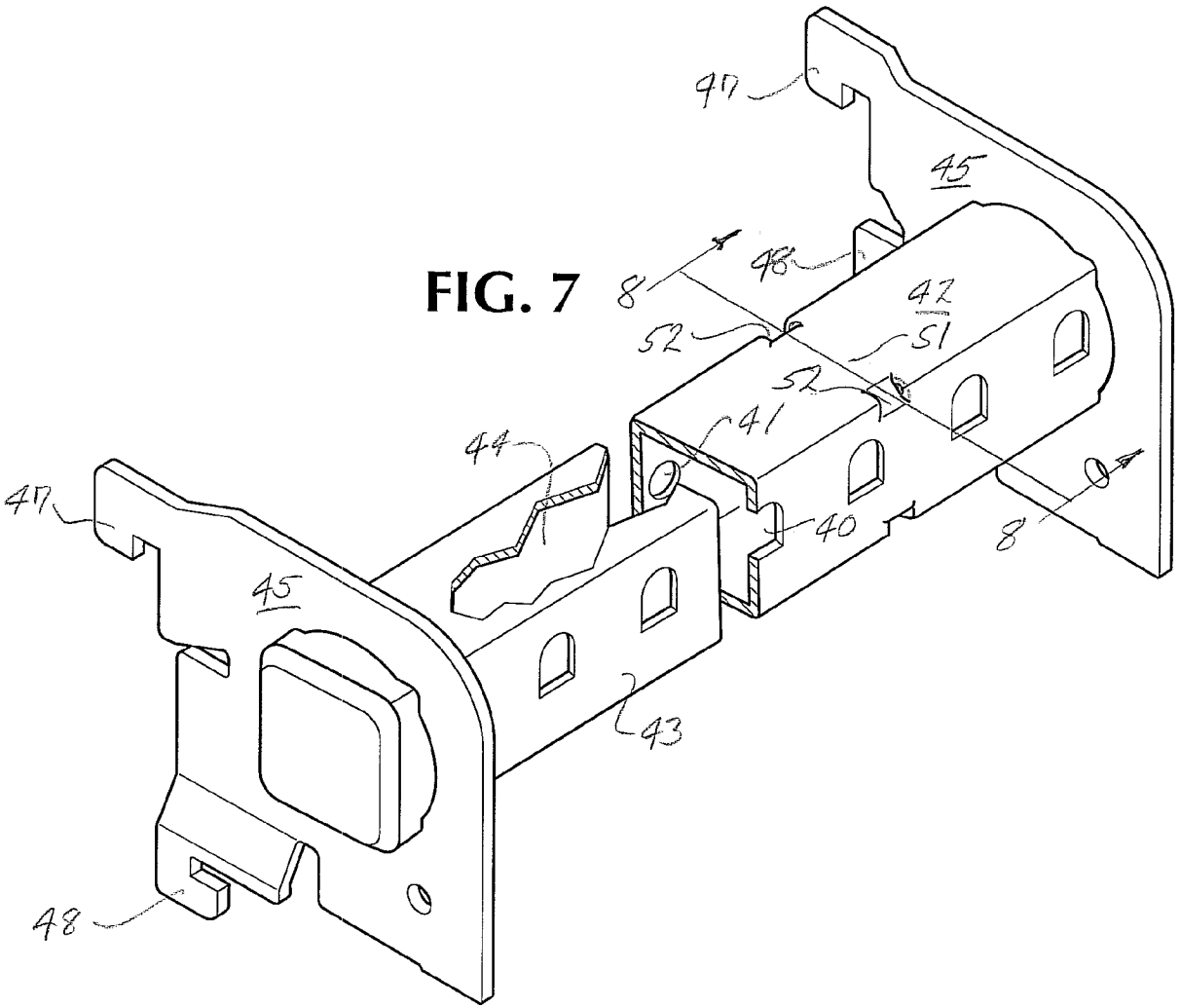
FIG. 7 is a perspective view of a second embodiment of the invention, with special accommodations for a display bar which must be retained in a predetermined rotational orientation.
Figure 8:
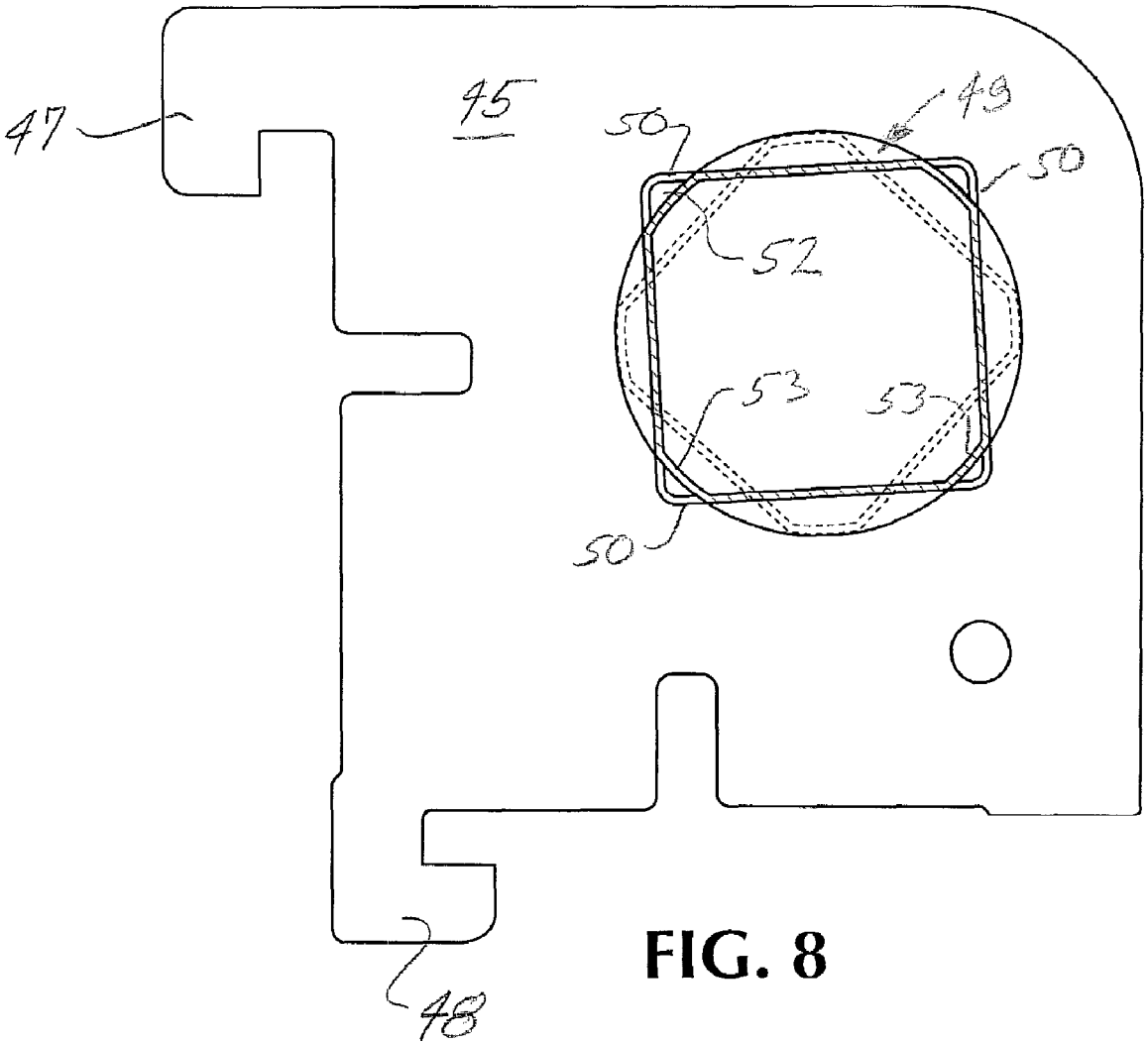
FIG. 8 is a cross sectional view as taken generally along line 8-8 of FIG. 7.

As will be readily understood, the display bar 42 of FIGS. 7 and 8 must at all times be retained in a specific rotational orientation, with front and back sides 43, 44 thereof more or less vertically oriented, in order for the display hooks to be supported in the necessary orientation for the display of merchandise. Accordingly, in order to bring a new set of slot-engaging hooks 47 or 48 into operative position with respect to slotted uprights, it is necessary for the mounting brackets to be rotated with respect to the display bar. At the same time, pursuant to the invention, the mounting brackets are not to be removed from the display bar.

In the embodiment of the invention shown in FIGS. 7 and 8, the mounting brackets 45, which otherwise correspond closely with the mounting brackets 14 of FIGS. 1-6, are provided with specially configured openings 49 for receiving the display bar 42 in a manner normally to secure the display bar against rotation, while permitting rotation of the mounting brackets when necessary. As shown best in FIG. 8, the openings 49 are primarily circular in form and are of a diameter that is slightly less than the corner-to-corner diagonal dimensions of the display bar 42. In order to receive the display bar, the bracket openings 49 are provided with recesses 50 at locations corresponding to the corner positions of the display bar when the bar is properly oriented with respect to the mounting brackets 45. The recesses 50 allow the mounting brackets to be slidably moved longitudinally along the display bar 42 to adjust the bracket spacing properly to that of a pair of slotted uprights 11, 12 (FIG. 1), while at the same time locking the display bar against rotation relative to the mounting brackets.

To accommodate rotation of the brackets 45, when it is desired to operationally exchange the positions of the slot-engaging hooks 47, 48, the display bar is provided with a region 51 of limited axial length which is formed with a reduced cross sectional configuration. The maximum dimension of the region 51 is slightly less than the diameter of the generally circular opening 49. Accordingly, when a bracket 45 is moved axially into alignment with the region 51, the bracket may be rotated 90° relative to the display bar, to bring a new hook 47, 48 into operative position without changing the orientation of the display bar. Although it is not necessary to the invention, it is generally advantageous for the width of the region 51 to be sufficient to receive both brackets simultaneously, so that both brackets may be rotationally repositioned together. Only one such region 51 of reduced cross section is required and it may be located anywhere along the bar 42, although preferably spaced from any set of holes 40, 41.

In a preferred embodiment of the invention, the region 51 of reduced cross section of formed by providing corner notches 52 to a sufficient depth to enable the notched region of the display bar to rotate within the circular portions of the opening 49, substantially as illustrated in FIG. 8. Although the corner notches 52 may be formed by simply cutting away corner sections of the display bar, it is preferable to form them by inward displacement of the metal sections 53 in the notch areas, as shown in FIG. 8.

An important practical advantage of the invention is that the display bar and its mounting brackets constitute a unitary assembly, with the mounting brackets being permanently joined with the display bar. Important savings in both cost and man-hours of store labor can be realized by avoiding the annoying problem of lost and misplaced components, which inevitably occurs when the mounting brackets are not a fixed part of the display assembly. At the same time, where the display bar must be oriented in a particular manner, while enabling rotational re-orientation of the mounting brackets, the assembly of the invention includes a novel, simplified and inexpensive arrangement to provide that capability.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A display bar assembly for mounting on spaced apart slotted uprights on a merchandising wall, which comprises (a) a tubular display bar of polygonal cross section and of predetermined length, (b) first and second mounting brackets for securing said display bar to said spaced apart uprights, (c) said mounting brackets each having a shaped opening for close-fitting but slideable, normally non-rotating reception of said display bar, (d) said opening being sufficiently closed on all sides that said display bar normally cannot be removed therefrom by movement in a direction transverse to a longitudinal axis of the display bar, (e) each of said mounting brackets having a plurality of right angularly spaced side edges and a plurality of slot engaging hooks for engaging slots in front walls of said uprights in a plurality of rotational orientations of said brackets, (f) said slot engaging hooks having portions spaced from and extending for a distance along adjacent side edges of said brackets and forming with said side edges a plurality of recesses for reception of front wall portions of adjacent said uprights, (g) each of said recesses of each of said mounting brackets being unidirectionally oriented, to open in the same clockwise direction, (h) said mounting brackets being slideably adjustable lengthwise along said display bar to match the spacing between said slotted uprights, and (i) retainer means provided on said display bar at each end thereof, and (j) said retainer means having portions projecting beyond outer surface portions of said display bar to provide positive retention of said slideable mounting brackets on said display bar, (k) said display bar having a region of limited axial length having a cross sectional configuration accommodating rotation of said brackets relative to said display bar, whereby a different set of slot engaging hooks may be presented to said slotted uprights without requiring a new rotational orientation of said display bar.

2. A display bar assembly for mounting on spaced apart slotted uprights on a merchandising wall, which comprises (a) a tubular display bar of polygonal cross section and of predetermined length, (b) first and second mounting brackets for securing said display bar to said spaced apart uprights, (c) said mounting brackets each having a shaped opening for close-fitting but slideable, normally non-rotating reception of said display bar, (d) said opening being sufficiently closed on all sides that said display bar normally cannot be removed therefrom by movement in a direction transverse to a longitudinal axis of the display bar, (e) each of said mounting brackets having a plurality of angularly spaced slot engaging hooks for engaging slots in said uprights in a plurality of rotational orientations of said brackets, (f) said mounting brackets being slideably adjustable lengthwise along said display bar to match the spacing between said slotted uprights, and (g) retainer means provided on said display bar at each end thereof, (h) said retainer means having portions projecting beyond outer surface portions of said display bar to provide positive retention of said slideable mounting brackets on said display bar, (i) said display bar having a region of limited axial length, spaced from its ends, having a cross sectional configuration accommodating rotation of said brackets relative to said display bar, whereby a different set of slot engaging hooks may be presented to said slotted uprights without requiring a new rotational orientation of said display bar, (j) said shaped opening having portions of generally circular configuration having a diameter less than a diagonal corner-to-corner cross sectional dimension of said display bar, (k) said shaped opening further having angularly spaced recesses extending beyond the generally circular configuration of said shaped opening and positioned to receive corner areas of said display bar for non-rotationally engaging said bar, and (l) said display bar being non-rotationally engaged by said mounting brackets except when a mounting bracket is positioned axially within said region of limited axial length.

3. A display bar assembly according to claim 1, wherein (a) said display bar has only a single region of limited axial length, and (b) the axial length of said region is slightly greater than the combined thicknesses of said mounting brackets, whereby said first and second brackets may be received simultaneously in said region and rotated simultaneously with respect to said display bar.

4. A display bar assembly according to claim 1, wherein (a) said display bar is formed with a plurality of axially spaced apart openings for the reception of display hooks, (b) said plurality of openings have a common orientation, for predetermined orientation of said display hooks, and (c) said predetermined orientation is substantially retained when said brackets are moved to a new rotational orientation with respect to said display bar to present a new set of slot engaging hooks to said slotted uprights.

5. A display bar assembly according to claim 1, wherein (a) each of the slot engaging hooks of each of said mounting brackets defines, with its adjacent side edge, a recess of a width different from a width of a recess defined by each other slot engaging hook of the same bracket, for reception on uprights of different front wall thicknesses.

6. A display bar assembly according to claim 5, wherein (a) said display bar is of rectangular configuration, and (b) said mounting brackets have two side edges disposed substantially at right angles and each side edge being provided with one of said slot engaging hooks.

7. A display bar assembly for mounting on spaced apart slotted uprights on a merchandising wall, which comprises, (a) a display bar of predetermined length suitable for support by said uprights, (b) first and second mounting brackets for securing said display bar to said spaced apart uprights, (c) said mounting brackets each having an opening for slideable and normally non-rotational reception of said display bar, (d) said opening being sufficiently closed on all sides that said display bar normally cannot be removed therefrom by movement in a direction transverse to a longitudinal axis of the display bar, (e) said mounting brackets each further having a plurality of right angularly spaced unidirectionally oriented slot engaging elements for reception in slots of a spaced apart pair of uprights in a plurality of rotational orientations of said mounting brackets, (f) retainer means on said display bar at each end thereof, (g) said retainer means having portions projecting beyond outer surface portions of said display bar to provide positive retention of said slideable mounting brackets on said display bar, (h) said display bar having a region of limited axial length having a cross sectional configuration, in relation to the cross sectional configuration of said mounting bracket openings, accommodating rotation of said brackets relative to said display bar, whereby a different set of slot engaging hooks may be presented to said slotted uprights without requiring a new rotational orientation of said display bar, and (i) said region of limited axial length has a length at least as long as a thickness of a mounting bracket.

8. A display bar assembly according to claim 7, wherein (a) said region of limited axial length has a length at least as long as combined thickness of said mounting brackets, whereby both of said brackets may be received simultaneously in said region and rotated simultaneously with respect to said display bar.

9. A display bar assembly for mounting on spaced apart slotted uprights on a merchandising wall, which comprises, (a) a display bar of predetermined length corresponding in general with the space between said uprights, (b) first and second mounting brackets for securing said display bar to said spaced apart uprights, (c) said mounting brackets each having an opening for close fitting but slideable and normally non-rotational reception of said display bar, (d) said opening being sufficiently closed on all sides that said display bar normally cannot be removed therefrom by movement in a direction transverse to a longitudinal axis of the display bar, (e) said mounting brackets each further having a plurality of angularly spaced upright-engaging elements for securing said assembly to a spaced apart pair of uprights in a plurality of rotational orientations of said mounting brackets, (f) retainer means on said display bar at each end thereof, (g) said retainer means having portions projecting beyond outer surface portions of said display bar to provide positive retention of said slideable mounting brackets on said display bar, (h) said display bar having a region of limited axial length, spaced from its ends, having a cross sectional configuration, in relation to the cross sectional configuration of said mounting bracket openings, accommodating rotation of said brackets relative to said display bar, whereby a different set of slot engaging hooks may be presented to said slotted uprights without requiring a new rotational orientation of said display bar, (i) said display bar being of generally square cross section, (j) said bracket openings being of generally circular form and of a diameter less than a diagonal corner-to-corner dimension of said display bar, (k) said bracket openings further having circumferentially spaced apart recesses formed therein for reception of corner areas of said display bar to enable non-rotational reception of said display bar in said bracket openings, and (l) said display bar being formed with corner notches in said region of limited axial length which, when axially aligned with one of said mounting brackets, enables rotation of said mounting bracket with respect to said display bar.

10. A display bar assembly according to claim 9, wherein (a) said corner notches are formed by inward displacement of corner areas of said display bar.

11. A display bar assembly according to claim 7, wherein (a) said display bar has front and back walls and is provided with axially spaced apart pairs of front and back openings in said front and back walls for the reception and support of display hooks.

* * * * *